US006716793B2

(12) United States Patent
Kubota et al.

(10) Patent No.: US 6,716,793 B2
(45) Date of Patent: Apr. 6, 2004

(54) IMAGE-RECORDING COMPOSITION AND IMAGE-RECORDING SHEET USING SAME

(75) Inventors: Yukio Kubota, Saitama-ken (JP); Minoru Suzuki, Tochigi-ken (JP); Kazuyuki Shimbo, Kanagawa-ken (JP)

(73) Assignee: Pentax Corporation, Tokyo (JP)

( * ) Notice: Subject to any disclaimer, the term of this patent is extended or adjusted under 35 U.S.C. 154(b) by 0 days.

(21) Appl. No.: 09/858,667

(22) Filed: May 17, 2001

(65) Prior Publication Data

US 2003/0087757 A1 May 8, 2003

(30) Foreign Application Priority Data

May 17, 2001 (JP) ..... 2000-145521

(51) Int. Cl.[7] ..... B41M 5/30

(52) U.S. Cl. ..... 503/209; 106/31.18; 428/402.2; 428/402.21; 503/204; 503/215; 503/216

(58) Field of Search ..... 503/204, 208, 503/209, 215, 216; 106/31.18; 428/402.2, 402.21

(56) References Cited

U.S. PATENT DOCUMENTS 4,644,376 A * 2/1987 Usami et al. ..... 346/215
4,682,194 A * 7/1987 Usami et al. ..... 503/215
4,749,679 A * 6/1988 Yoshida et al. ..... 503/208
5,463,133 A * 10/1995 Sato et al. ..... 568/33
5,582,956 A * 12/1996 Ehret et al. ..... 430/337
6,139,914 A * 10/2000 Suzuki et al. ..... 427/213.3
6,210,053 B1 * 4/2001 Suzuki et al. ..... 400/120.01
6,228,441 B1 * 5/2001 Suzuki et al. ..... 428/12
6,243,161 B1 * 6/2001 Suzuki et al. ..... 355/400
6,246,423 B1 * 6/2001 Suzuki et al. ..... 346/76.1

FOREIGN PATENT DOCUMENTS

JP 6-127148 * 5/1994

* cited by examiner

*Primary Examiner*—B. Hamilton Hess
(74) *Attorney, Agent, or Firm*—Greenblum & Bernstein, P.L.C.

(57) ABSTRACT

An image-recording composition comprising: a microcapsule enclosing a leuco-dye; a phenol color-developing agent; and a reaction-accelerating agent catalyzing a color-developing reaction between the leuco-dye and the phenol color-developing agent, the reaction-accelerating agent being an organic compound having at least two carboxyl groups. An image-recording sheet comprising a substrate and a color-developing layer disposed by applying the image-recording composition to the substrate is also provided.

10 Claims, 1 Drawing Sheet

IMAGE-RECORDING COMPOSITION AND IMAGE-RECORDING SHEET USING SAME

BACKGROUND OF THE INVENTION

The present invention relates to an image-recording composition, particular to a pressure-sensitive, heat-sensitive image-recording composition, which rapidly develops a color even at a low temperature of 50 to 90° C. to provide a clear image in a short time, thereby being useful for a high-resolution printer. The present invention also relates to an image-recording sheet using the image-recording composition.

Conventionally, high-resolution image-recording has been achieved by pressure-sensitive, heat-sensitive image-recording methods using a microcapsule composed of a shell wall enclosing a color-producing agent such as a leuco-dye, etc. The color-producing agent reacts with a color-developing agent to exhibit a color. A pressure-sensitive, heat-sensitive image-recording sheet produced by applying the microcapsule and the color-developing agent to a sheet is used in a typical pressure-sensitive, heat-sensitive image-recording methods. The image-recording sheet is heated under a pressure by a thermal head, etc., whereby the microcapsule is broken to release the color-producing agent. Then, the color-producing agent reacts with the color-developing agent to provide an image on the sheet.

In the pressure-sensitive, heat-sensitive image-recording methods, the shell wall of the microcapsule is controlled with respect to the thickness and material, such that the microcapsule is broken only by heating at a predetermined breaking temperature under a predetermined breaking pressure. Thus, a high resolution multi-color image can be obtained by these methods if several kinds of microcapsules, which are broken at a different breaking temperature under a different breaking pressure to exhibit a different color such as cyan, magenta, yellow, etc., are applied to the sheet.

Although the breaking temperature of the microcapsule is generally 100° C. or more, preferably 120° C. or more from the viewpoint of stability and reliability of the image-recording sheet, the breaking temperature and the breaking pressure of each microcapsule should be controlled to selectively break only one desired kind of microcapsule in the case of using the several kinds of microcapsules. For example, when three kinds of microcapsules are used for the image-recording sheet as shown in FIG. 1, a cyan-exhibiting region A, a magenta-exhibiting region B and a yellow-exhibiting region C must not be overlapped. Therefore, in this case, at least one kind of microcapsule preferably has a low breaking temperature.

However, even if the microcapsule has a low breaking temperature, the leuco-dye is often poor in the color-developing reaction rate, thereby requiring long period of time, several hours, in developing a sufficiently deep color. Particularly, yellow color developed by the leuco-dye is extremely low in depth, resulting in a multi-color image poor in color balance.

OBJECT AND SUMMARY OF THE INVENTION

An object of the present invention is to provide an image-recording composition that rapidly develops a color not depending on kind of leuco-dye to provide a clear image in a short time, and an image-recording sheet using the image-recording composition.

As a result of intense research in view of the above object, the inventors have found that an image-recording composition comprising: a microcapsule enclosing a leuco-dye; a phenol color-developing agent; and a reaction-accelerating agent catalyzing a color-developing reaction between the leuco-dye and the phenol color-developing agent, where an organic compound having at least two carboxyl groups is used as the reaction-accelerating agent, can rapidly develop a color to be made practicable. The present invention has been accomplished by the finding.

The reaction-accelerating agent used in the present invention is not such that acts to reduce color-developing temperature as a sensitizer. The reaction-accelerating agent does not affect the color-developing agent before breaking the microcapsule, and it accelerates the color-developing reaction so that the leuco-dye reacts with the color-developing agent to exhibit a color immediately after breaking the microcapsule. Every leuco-dye including such as poor in the color-developing reaction rate can rapidly develop a color by the reaction-accelerating agent in the present invention. Therefore, in the case of using a plurality of leuco-dyes, the image-recording composition of the present invention can provide a multi-color image excellent in color balance.

Generally, a leuco-dye high in the color-developing reaction rate is also high in the color-discharging rate. Thus, to rapidly develop a color and not to discharge the color for a long time, a plurality of leuco-dyes including a dye high in the color-developing reaction rate, a dye poor in the color-developing reaction rate, a dye balancing the developed color, etc. have been used even in the mono-color image-recording sheet. According to the present invention, the color-developing reaction rate is controlled by the reaction-accelerating agent, whereby the number of the leuco-dyes and the amount of the color-developing agent is reduced to reduce costs.

In the image-recording composition of the present invention, the ratio of [the number of the carboxyl groups of the reaction-accelerating agent]/[the number of carbon atom (s) of the reaction-accelerating agent other than carbon atoms forming the carboxyl groups] is preferably 0.2 or more. The ratio is hereinafter referred to as "carboxyl group-content". The reaction-accelerating agent having a high carboxyl group-content sufficiently accelerates the color-developing reaction.

DETAILED DESCRIPTION OF THE PREFERRED EMBODIMENTS

[I] Image-Recording Composition

Figure 1:
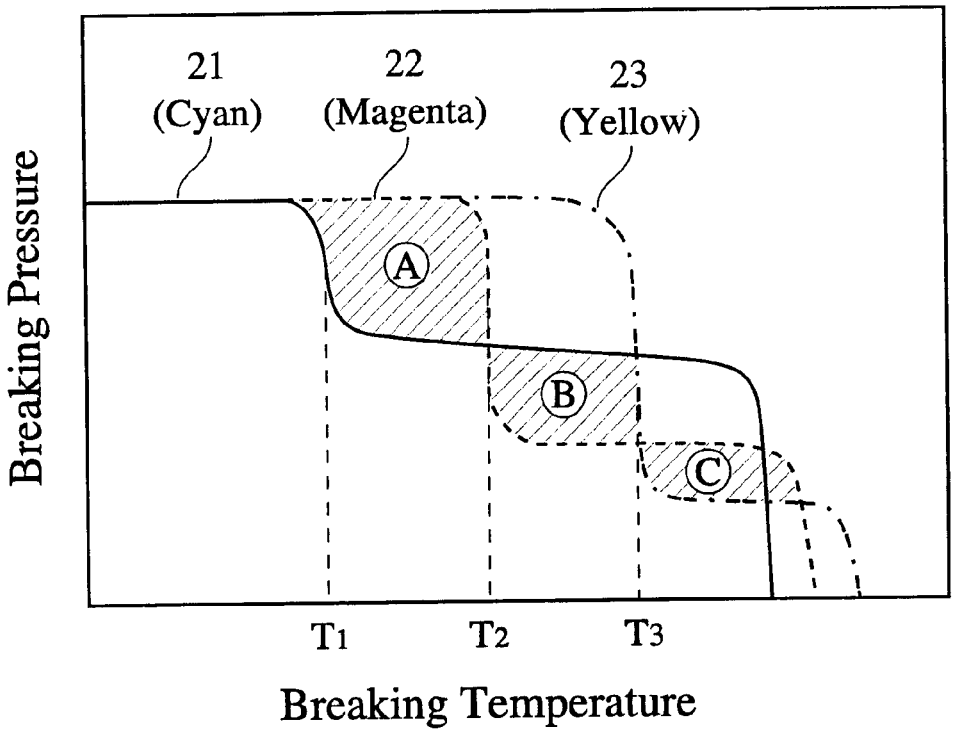
FIG. 1 is a graph showing relations between a breaking temperature and a breaking pressure according to three kinds of microcapsules.

An image-recording composition of the present invention comprises: a microcapsule enclosing a leuco-dye; a phenol color-developing agent; and a reaction-accelerating agent catalyzing a color-developing reaction between the leuco-dye and the phenol color-developing agent.

The image-recording composition may further comprise a sensitizer, if necessary. The sensitizer acts to lower an apparent melting point of the phenol color-developing agent, so that the image-recording composition comprising the sensitizer can develop a sufficiently deep color even at a low temperature. Components of the image-recording composition according to the present invention will be described in detail below.

(1) Reaction-Accelerating Agent

The image-recording composition of the present invention comprises an organic compound having at least two carboxyl groups as the reaction-accelerating agent. The reaction-accelerating agent increases the rate of the color-developing reaction between the leuco-dye and the phenol color-developing agent, whereby they can rapidly develop the deep color not depending on kind thereof. The image-recording composition can provide an image even at a low temperature. The temperature is preferably 40 to 95° C., more preferably 50 to 90° C., particularly preferably 60 to 80° C.

The carboxyl group-content of the reaction-accelerating agent is preferably 0.2 or more, more preferably 0.5 or more, particularly preferably 1.0 or more. Such a reaction-accelerating agent that has a high carboxyl group-content sufficiently increases the color-developing reaction rate, so that the image-recording composition comprising the reaction-accelerating agent can provide an image even at a low temperature. When the carboxyl group-content is less than 0.2, there is a case where the image-recording composition exhibits an insufficient color-developing reaction rate.

The reaction-accelerating agent may have a substituent other than the carboxyl group, which does not remarkably inhibit the reaction-accelerating effect thereof. The substituent must not be such that develops a color at room temperature. For example, the reaction-accelerating agent having a phenolic hydroxyl group is not preferable because it often acts as the color-developing agent at room temperature.

Preferable examples of the reaction-accelerating agent include: (i) carboxylated aliphatic hydrocarbons that may be straight, branched, cyclic, cross linking, or spiro compound; (ii) carboxylated aromatic compounds that may have a monocyclic structure or a polycyclic structure such as a condensed ring and a ring assemblage; (iii) carboxylated heterocyclic compounds that may have a monocyclic structure or a polycyclic structure such as a condensed ring and a ring assemblage; (iv) oligomers and polymers having the carboxyl groups; etc.

The carboxylated aliphatic hydrocarbons of (i) preferably have 1 to 20 carbon atom, specific examples thereof including malonic acid, succinic acid, maleic acid, citric acid, 1,2,3-propanetricarboxylic acid, butanetetracarboxylic acid, sebacic acid, 1,2,3,4-cyclopentanetetracarboxylic acid, 1,2,3,4,5,6-cyclohexanehexacarboxylic acid, etc.

The carboxylated aromatic compounds of (ii) preferably have 6 to 20 carbon atoms, specific examples thereof including mellitic acid, pyromellitic acid, hemimellitic acid, trimellitic acid, phthalic acid, etc.

The carboxylated heterocyclic compound of (iii) preferably have 4 to 20 carbon atoms, specific examples thereof including tetrahydrofuran-2,3,4,5-tetracarboxylic acid, etc.

The oligomers and the polymers of (iv) preferably have a molecular weight of 2000 to 50000, specific examples thereof including polyacrylic acid, maleic anhydride-vinyl compound copolymers such as maleic anhydride-ethylene copolymers, maleic anhydride-styrene copolymers and maleic anhydride-isobutylene copolymers, etc.

Among them, more preferred are 1,2,3-propanetricarboxylic acid, butanetetracarboxylic acid, 1,2,3,4,5,6-cyclohexanehexacarboxylic acid and polyacrylic acid.

Also preferably used as the reaction-accelerating agent are compounds composed of a plurality of carboxyl groups bonded to each other, such as oxalic acid.

The reaction-accelerating agent may be neutralized by potassium hydroxide, etc., whereby each of the carboxyl groups may form a carboxylate.

In general, as the concentration of the reaction-accelerating agent in the image-recording composition becomes higher, the image-recording composition exhibits a higher color-developing reaction rate. However, when the concentration of the reaction-accelerating agent is too high, the reaction-accelerating agent often acts to develop a color at room temperature, thereby inhibiting the phenol color-developing agent. The concentration of the reaction-accelerating agent is preferably less than such a concentration that the leuco-dye released by an unexpected pressure produces a color without heating. Although the concentration of the reaction-accelerating agent may be properly selected depending on the kind thereof, it is preferably 0.3 part by weight or less, more preferably 0.01 to 0.3 part by weight, furthermore preferably 0.02 to 0.1 part by weight, particularly preferably 0.03 to 0.05 part by weight based on 1 part by weight of the phenol color-developing agent.

(2) Phenol Color-Developing Agent

The phenol color-developing agent reacts with the leuco-dye released from the microcapsule to make the leuco-dye produce a color.

The phenol color-developing agent is almost odorless and has a high melting point of from one hundred-several ten to 300° C. according to its structure. The melting point of the phenol color-developing agent is preferably lowered by the sensitizer so that the color-developing reaction is carried out at a desired low temperature.

Examples of the phenol color-developing agent used in the present invention include p-octylphenol, p-t-butylphenol, p-phenylphenol, p-hydroxyacetophenone, α-naphthol, β-naphthol, p-t-octylcatechol, 2,2'-dihydroxybiphenyl, Bisphenol A, 1,1-bis(p-hydroxyphenyl)butane, 2,2-bis(4-hydroxyphenyl)heptane, 2,2-bis(3-methyl-4-hydroxyphenyl)propane, 2,2-bis(3,5-dimethyl-4-hydroxyphenyl)propane, 2,2-bis(3,5-dichloro-4-hydroxyphenyl)propane, bis(4-hydroxyphenyl)sulfone, bis(3-aryl-4-hydroxyphenyl)sulfone, bis(3,4-dihydroxyphenyl)sulfone, 2,4'-dihydroxydiphenylsulfone, 1,1-bis(4-hydroxyphenyl)cyclohexane, bis(4-hydroxyphenyl)ether, bis[2-(4-hydroxyphenylthio)ethoxy]methane, 4-(4-isopropoxybenzensulfonyl)phenol, dimethyl 4-hydroxyphthalate, butyl bis(4-hydroxyphenyl)acetate, benzyl p-hydroxybenzoate, 3,5-di-t-butyl salicylic acid, 2,4-dihydroxybenzanilide, 2,4-dihydroxy-2'-methoxybenzanilide, 2,4-dihidroxy-2',4'-dimethylbenzanilide, 2,4-dihydroxy-2'-methoxy-5'-methylbenzanilide, bis(4-(2,4-dihydroxyphenylcarbonylamino)-3-methoxyphenyl)methane, 4-methylbenzene sulfonic acid-2-hydroxyanilide, oligomers and polymers having a phenol group, etc.

The phenol color-developing agent preferably has a number-average molecular weight (Mn) of 600 to 50,000. Further, the phenol color-developing agent preferably has four or more phenol groups.

The phenol color-developing agents having four or more phenol groups and Mn of 600 to 50,000 may be prepared by polymerization of monomers having a phenol group, or by introducing a phenol group into a polymer. As compared with the monophenol color-developing agents, the bisphenol color-developing agents, etc., such phenol color-developing agents are more excellent in stability during storage, and lower in danger of endocrine disruptors because they are hardly absorbed into a human body. Specific examples of such phenol color-developing agents include: poly(p-hydroxystyrene) (molecular weight: 2,000 to 22,000); "ADK ARKLS K-5" manufactured by Asahi Denka Kogyo K.K. having a structure shown below (molecular weight: 2,000 to 4,000); "Hostanox O3" manufactured by Clariant Japan K.K. (bis[3,3-bis(4'-hydroxy-3'-t-butylphenyl)butanoic acid]-glycol ester, molecular weight: 794); etc.

ADK ARKLS K-5

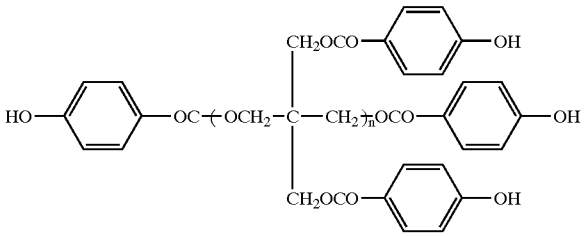

In the present invention, a known color-developing agent such as a carboxylic acid color-developing agent, a metal salt color-developing agent, etc. may be used in combination with the above phenol color-developing agent to increase the color-developing sensitivity of the image-recording composition. The amount of the phenol color-developing agent may be reduced by using the other color-developing agents in combination therewith.

(3) Microcapsule

The microcapsule used for the image-recording composition of the present invention is composed of a shell wall and a core material encapsulated therein. The shell wall is preferably made of a non-thermoplastic synthetic resin, and the core material is preferably prepared by dispersing the leuco-dye in an appropriate solvent.

The leuco-dye is generally colorless or light-colored compound that is oxidized to be colorized. The leuco-dye preferably has a phenolphthalein structure as a fluorane dye. The phenolphthalein structure is preferably converted into a colorized structure by an acid catalyst. A plurality of leuco-dyes may be used in combination with each other. Specific examples of the leuco-dye used in the present invention are shown below.

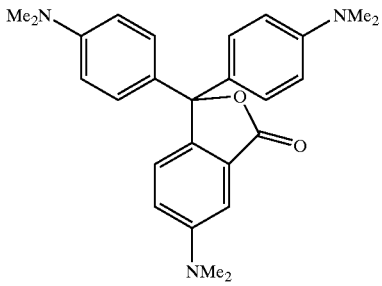

Purple Blue

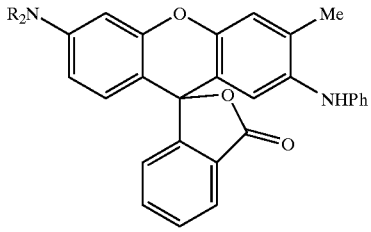

Black

R: Alkyl Group

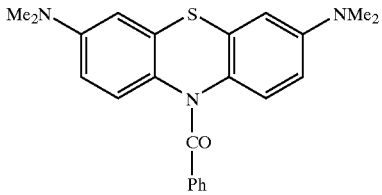

Blue

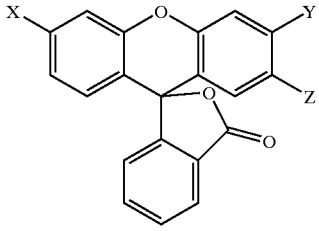

| X | Y | Z | |
|---|---|---|---|
| OMe | OMe | H | Yellow |
| $NEt_2$ | H | Cl | Orange |
| $NEt_2$ | H | 7,8-Benzo | Pink |
| $NEt_2$ | Me | $NBz_2$ | Red |

-continued

| | | | |
|---|---|---|---|
| $NEt_2$ | H | $NBz_2$ | Green |
| 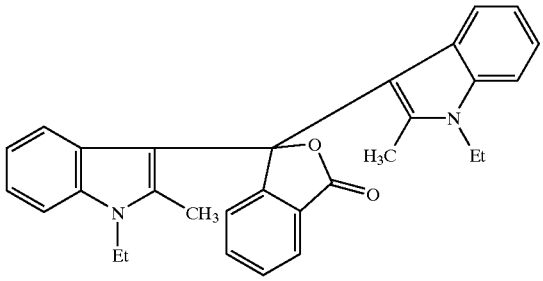 | | | Red |
| 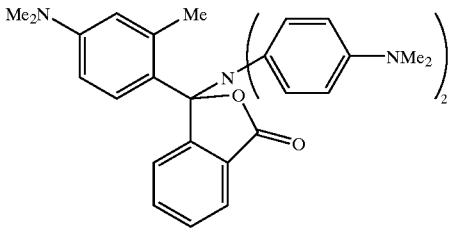 | | | Black |
| 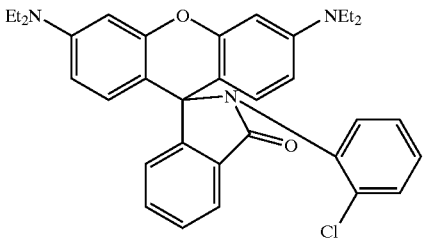 | | | Red |
| 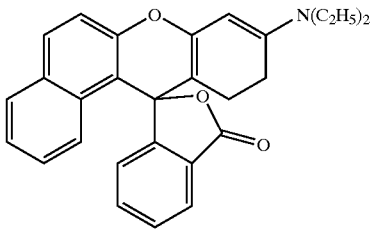 | | | Red |
| 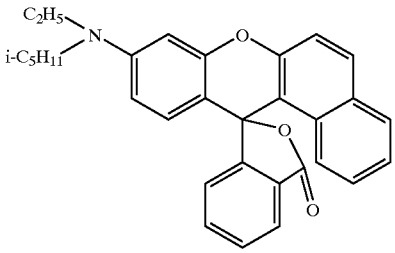 | | | Red |

The weight ratio of the leuco-dye is preferably 0.1 to 40 weight %, more preferably 0.5 to 20 weight %, particularly preferably 1 to 15 weight % to 100 weight % of the core material. When the weight ratio is less than 0.1 weight %, the image-recording composition cannot develop a sufficiently deep color, failing to provide a clear image. On the other hand, when the weight ratio is more than 40 weight %, it is difficult to prepare the microcapsule.

The microcapsule used in the present invention may be prepared by a well-known method such as a coacervation method, an interfacial polymerization method, an in-situ method, etc.

Known as the microcapsule prepared by the in-situ method are a polyurethane microcapsule, a melamine-formalin resin microcapsule, etc.

To prepare the polyurethane microcapsule, a polyisocyanate compound and a polyhydroxy compound are dissolved in an oil, and the resultant oil is emulsified and dispersed in a protective colloid aqueous solution. Then, the protective colloid aqueous solution is heated so that the polyisocyanate compound and the polyhydroxy compound react to form the shell wall.

To prepare the melamine-formalin resin microcapsule, a water-soluble melamine-formalin prepolymer is generally used. An oil dissolving a leuco-dye is emulsified and dispersed in a protective colloid aqueous solution to provide an o/w emulsion, then, an aqueous solution containing the water-soluble melamine-formalin prepolymer is added to the o/w emulsion and stirred under slightly acidic condition (pH: 3 to 6) while heating, whereby a melamine-formalin polymer is deposited at the o/w interface to form the shell wall. The protective colloid may be an acid catalyst that accelerates polycondensation reaction between melamine and formalin, such as a styrene sulfonic acid polymer, a copolymer of styrene and maleic anhydride, a copolymer of ethylene and maleic anhydride, gum arabic, polyacrylic acid, etc.

The microcapsule is not limited to the above-mentioned polyurethane microcapsule and melamine-formalin resin microcapsule. Every known microcapsule may be used in the present invention, if only it is not broken during storage and transport, and it can be broken at a predetermined breaking temperature under a predetermined breaking pressure to release the leuco-dye.

Weight ratio of the microcapsule to the entire image-recording composition is preferably controlled to 1 to 25 weight % by changing the water-amount of suspension or dispersion containing the microcapsule.

(4) Sensitizer

The sensitizer used in the present invention is preferably represented by the following formula (I):

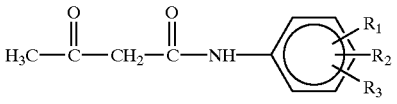

(I)

wherein $R_1$, $R_2$ and $R_3$ independently represent a hydrogen atom, a halogen atom, or an alkyl or alkoxy group having 1 to 8 carbon atom.

Specific examples of the sensitizer represented by the formula (I) include acetoacetic acid anilide, acetoacetic acid 2,5-dimethoxyanilide, acetoacetic acid σ-anisidide, acetoacetic acid m-xylidide, acetoacetic acid σ-chloroanilide, acetoacetic acid 2,5-methoxyl-4-chloroanilide, acetoacetic acid σ-toluidide, acetoacetic acid p-toluidide, etc. Among them, particularly preferred are acetoacetic acid anilide and acetoacetic acid 2,5-dimethoxyanilide.

Kind and amount of the sensitizer may be appropriately selected such that the melting point of the phenol color-developing agent is lowered below the color-developing temperature and that the image-recording composition is not colored at room temperature. Weight ratio of the sensitizer is preferably 1/10 to 1 part by weight, more preferably 1/5 to 1/3 part by weight based on 1 part by weight of the phenol color-developing agent.

(5) Binder Resin

The image-recording composition of the present invention may comprise a binder resin such as a water-soluble polymer. Examples of the water-soluble polymer include methylcellulose, hydroxyethylcellulose, hydroxypropylcellulose, starch derivatives, casein, gum arabic, gelatin, polyvinylalcohol, modified epichlorohydrin polyamides, polyacrylamide, modified compounds thereof, etc.

(6) Additives

The image-recording composition of the present invention may comprise an additive such as a filler.

The filler may be organic or inorganic agent conventionally known. Specific examples thereof include kaolin, calcined kaolin, talc, pyrophyllite, diatomaceous earth, calcium carbonate, aluminum hydroxide, magnesium hydroxide, zinc oxide, lithopone, amorphous silica, colloidal silica, calcined gypsum, silica, magnesium carbonate, titanium oxide, alumina, barium carbonate, barium sulfate, mica, micro-balloon, urea-formalin filler, polyester particle, cellulose filler, etc.

Other addictives such as a wax, an antistatic agent, an antifoaming agent, a conductance agent, a fluorescent dye, a surface-active agent, an ultraviolet-absorbing agent, precursors thereof, etc. may be also added to the image-recording composition of the present invention.

[2] Image-Recording Sheet

An image-recording sheet of the present invention comprises a substrate and at least one color-developing layer disposed thereon. The color-developing layer is disposed by applying the above-mentioned image-recording composition comprising the microcapsule enclosing the leuco-dye, the phenol color-developing agent, the reaction-accelerating agent, the binder resin, the sensitizer, the additive, etc. to the substrate.

If the phenol color-developing agent, the sensitizer, etc. are solid at room temperature, they are generally atomized by an attritor such as a ball mill, an atomizer and a sand grinder, or by an emulsifying apparatus, to be added to the image-recording composition.

The image-recording composition may be applied to the substrate by an applicator method, a bar-coating method, a roll-coating method, a spray-coating method, a die-coating method, a dip-coating method, an air-knife coating method, etc. after adjusting the concentration thereof to such as appropriate for applying. The applying amount of the image-recording composition is preferably 0.5 to 20 g/$m^2$ by dry solid weight.

The substrate may be made of a paper that is used for ordinal heat sensitive papers, a plastic film-laminated paper, a synthetic paper, a plastic film, etc. A back coating layer may be disposed on the back surface of the substrate to improve curl valance or chemical resistance of the substrate. Also, a separate paper may be provided on the back surface of the substrate through an adhesive layer, to form the recording sheet in a label.

The image-recording sheet of the present invention may be useful for a facsimile, a printer, etc. Further, the image-recording sheet may be used as a price tag, a ticket, etc.

[3] Image-Recording Method

The color-developing layer of the image-recording sheet according to the present invention is selectively heated at a predetermined breaking temperature under a breaking pressure correspondingly to a desired image, so that the shell wall of the microcapsule is broken to release the leuco-dye, thereby providing an image on the sheet. Thus, according to such a pressure-sensitive, heat-sensitive image-recording sheet, the image can be provided only by heating and pressurizing without light emission. The heating and pressurizing may be achieved by a simple apparatus having a combination of thermal heads and platens.

The image-recording sheet of the present invention can provide a multi-color image. In the case of recording a multi-color image, the image-recording sheet preferably has a color-developing layer comprising at least two kinds of microcapsules that are broken under a different condition to release a leuco-dye exhibiting a different color. The microcapsules are selectively broken under a particular condition, respectively.

For example, in the case of the image-recording sheet providing a multi-color image of cyan, magenta and yellow, three kinds of microcapsules each enclosing a leuco-dye exhibiting cyan, magenta or yellow may be used for the color-developing layer. For example, when the color-developing layer is heated at a predetermined temperature under a predetermined pressure correspondingly to one microcapsule enclosing a cyan leuco-dye, the microcapsule is broken to release the cyan leuco-dye although the other microcapsules enclosing the magenta leuco-dye or the yellow leuco-dye is not broken. Thus, the color-developing layer is stepwise heated at a predetermined temperature under a predetermined pressure correspondingly to each microcapsule, whereby the multi-color image can be rapidly provided with ease.

FIG. 1 is a graph showing relations between a breaking temperature and a breaking pressure according to three kinds of microcapsules each enclosing a leuco-dye exhibiting cyan, magenta or yellow. As shown in FIG. 1, a cyan-exhibiting region A is provided by a breaking temperature/breaking pressure curve 21 according to the microcapsule enclosing the cyan leuco-dye and a breaking temperature/breaking pressure curve 22 according to the microcapsule enclosing the magenta leuco-dye. Similarly, a magenta-exhibiting region B and a yellow-exhibiting region C are provided by breaking temperature/breaking pressure curves 21 to 23.

In the case where the three kinds of microcapsules of FIG. 1 is comprised in the color-developing layer of the image-recording sheet according to the present invention, only the microcapsule enclosing the cyan leuco-dye is broken when a temperature and a pressure in the cyan-exhibiting region A are applied to the color-developing layer. Further, only the microcapsule enclosing the magenta leuco-dye is broken when a temperature and a pressure in the magenta-exhibiting region B are applied to the color-developing layer, and only the microcapsule enclosing the yellow leuco-dye is broken when a temperature and a pressure in the yellow-exhibiting region C are applied to the color-developing layer. The cyan-exhibiting region A, the magenta-exhibiting region B and the yellow-exhibiting region C are not overlapped with each other, whereby a cyan image, a magenta image and a yellow image are formed in this order stepwise to provide a multi-color image. According to the image-recording sheet of the present invention, because a deep color can be developed even at a lower temperature as compared with conventional image-recording sheets, the regions A to C can be easily designed that they are not overlapped with each other.

EXAMPLES

The present invention will be described in more detail below by reference to Examples without intention of restricting the scope of the present invention.

Example 1

4 g of crystal violet lactone (CVL) was dissolved in 100 g of 2,7-di-isopropylnaphthalene (KMC oil) to prepare a leuco-dye solution, and 5 g of polyvinylbenzenesulfonic acid (wherein part of the sulfonyl carboxyl groups being converted to a sodium sulfonate group) that acts as a protective colloid and an acid catalyst was dissolved in 95 g of a purified water to prepare a protective colloid aqueous solution. Then, the leuco-dye solution was mixed with the protective colloid aqueous solution, and emulsified and dispersed therein by a homogenizer such that droplets of the leuco-dye solution have an average diameter of approximately 4.5 $\mu$m, to provide an o/w emulsion.

14 g of melamine was mixed and made to react at 70° C. with 36 g of formalin (37 weight % formaldehyde aqueous solution) having pH of 9, which was controlled by 2 weight % NaOH aqueous solution beforehand. 50 g of purified water was added to this mixture and stirred immediately after melt of the melamine, to prepare a melamine-formalin prepolymer aqueous solution.

Then, thus-obtained o/w emulsion and melamine-formalin prepolymer aqueous solution were mixed, and to the resultant reaction mixture was added 20 weight % acetic acid aqueous solution at 30° C. while stirring, so that the reaction mixture has pH of 3 to 6. This reaction mixture was stirred at 65° C. for approximately 1 hour, whereby condensation polymerization (in situ polymerization) between the melamine and the formalin was carried out to prepare a microcapsule.

A suspension I containing 25 weight % of the above-described microcapsule; a suspension II containing 20 weight % of a phenol color-developing agent "ADK ARKLS K-5"; a suspension III containing 16 weight % of a sensitizer (acetoacetic acid anilide); an aqueous solution I containing 20 weight % of a binder (polyvinylalcohol having a polymerization degree of 500); and an aqueous solution II containing 20 weight % of a reaction-accelerating agent (butanetetracarboxylic acid) were mixed at a mixing ratio shown in Table 1 to prepare a coating liquid.

TABLE 1

| | |
|---|---|
| Suspension I | 1 ml |
| Suspension II | 1 ml |
| Suspension III | 0.5 ml |
| Aqueous Solution I | 0.5 ml |
| Aqueous Solution II | 0.03 ml |

The coating liquid was applied to a polyethyleneterephthalate sheet by a bar-coating method at a ratio of 5 g of dry solid weight per 1 $m^2$ of the sheet, and dried to produce an image-recording sheet of Example 1.

Thus-obtained image-recording sheet of Example 1 was printed an image by a pressure-sensitive, heat-sensitive printer with an exothermic resistance of 2800 Ω, a resolution of 300 dpi, a load of 0.7 MPa and a heat-applying time of 2 msec. Color-developing was started at applied voltage of approximately 8 V and temperature of approximately 85° C., and sufficiently deep color was obtained at applied voltage of 8.5 V. Hereinafter, the voltage and the temperature, at which color-developing is started, are referred to as "color-developing voltage" and "color-developing temperature", and the period required to develop a sufficient color is referred to as "color-developing period".

Examples 2 to 16 and Comparative Examples 1 to 3

Image-recording sheets of Examples 2 to 16 and Comparative Examples 2 and 3 were produced in the same manner as Example 1 except that reaction-accelerating agents shown in Table 2 were used instead of butanetetracarboxylic acid, respectively. Further, an image-recording sheet of Comparative Example 1 was produced in the same manner as Example 1 except that the reaction-accelerating agent was not used. Each of the image-recording sheets of Examples 2 to 16 and Comparative Examples 1 to 3 were printed an image in the same manner as Example 1. The results were also shown in Table 2.

TABLE 2

| Ex. No. | Reaction-Accelerating Agent | A* | B* | A/B* | C* | D* |
|---|---|---|---|---|---|---|
| Ex. 1 | Butanetetracarboxylic Acid | 4 | 4 | 1.00 | 8 V [85° C.] | Instant |
| Ex. 2 | 1,2,3-Propanetricarboxylic Acid | 3 | 3 | 1.00 | 8 V [85° C.] | Instant |
| Ex. 3 | Succinic Acid | 2 | 2 | 1.00 | 8 V [85° C.] | Instant |
| Ex. 4 | Maleic Acid | 2 | 2 | 1.00 | 8 V [85° C.] | Instant |
| Ex. 5 | Malonic Acid | 2 | 1 | 2.00 | 8 V [85° C.] | Instant |
| Ex. 6 | Oxalic Acid | 2 | 0 | | 8 V [85° C.] | Instant |
| Ex. 7 | Sebacic Acid | 2 | 8 | 0.25 | 8 V [85° C.] | Instant |
| Ex. 8 | 1,2,3,4,5,6-Cyclohexanehexacarboxylic Acid | 6 | 6 | 1.00 | 8 V [85° C.] | Instant |
| Ex. 9 | 1,2,3,4-Cyclopentanetetracarboxylic Acid | 4 | 5 | 0.80 | 8 V [85° C.] | Instant |
| Ex. 10 | Mellitic Acid | 6 | 6 | 1.00 | 8 V [85° C.] | Instant |
| Ex. 11 | Pyromellitic Acid | 4 | 6 | 0.66 | 8 V [85° C.] | Instant |
| Ex. 12 | Hemimellitic Acid | 3 | 6 | 0.50 | 8 V [85° C.] | Instant |
| Ex. 13 | Trimellitic Acid | 3 | 6 | 0.50 | 8 V [85° C.] | Instant |
| Ex. 14 | Tetrahydrofuran-2,3,4,5-Tetracarboxylic Acid | 4 | 4 | 1.00 | 8 V [85° C.] | Instant |
| Ex. 15 | Polyacrylic Acid (Molecular Weight: 5000) | — | — | 0.50 | 8 V [85° C.] | Instant |
| Ex. 16 | Maleic Anhydride-Isobutylene Alternating Copolymer (Molecular Weight: 6000) | — | — | 0.50 | 8 V [85° C.] | Instant |
| Comp. Ex. 1 | — | — | — | — | 8 V [85° C.] | 2 hours |
| Comp. Ex. 2 | Benzoic Acid | 1 | 6 | 0.17 | 8 V [85° C.] | 2 hours |
| Comp. Ex. 3 | Zinc Salicylate | 1 | 6 | 0.17 | E* | — |

A*: Number of carboxyl group of reaction-accelerating agent.
B*: Number of carbon atom of reaction-accelerating agent other than carbon atom forming carboxyl group.
A/B*: Carboxyl group-content.
C*: Color-developing voltage [Color-developing temperature].
D*: Color-developing period.
E*: Color was developed at room temperature.

As shown in Table 2, the image-recording sheets of Examples 1 to 16 according to the present invention were excellent in the color-developing reaction rate, whereby color-developing was started at a low temperature of 85° C. and sufficiently deep color was almost instantly obtained.

On the other hand, the image-recording sheet of Comparative Example 1 using no reaction-accelerating agent necessitated long period of time in providing a sufficiently deep color, although the color-developing temperature thereof was equal to those of the image-recording sheets of Examples 1 to 16. The image-recording sheet of Comparative Example 2 also could not provide a sufficiently deep color immediately after the printing. This seemed because benzoic acid used as the reaction-accelerating agent did not have at least two carboxyl groups. Further, the image-recording sheet of Comparative Example 3 using zinc salicylate as the reaction-accelerating agent disadvantageously developed a color at room temperature, failing to act as the pressure-sensitive, heat-sensitive image-recording sheet.

As described in detail above, an image-recording composition of the present invention comprises an organic compound having at least two carboxyl groups as a reaction-accelerating agent to exhibit increased color-developing reaction rate. Thus, every leuco-dye can rapidly exhibit a color in the present invention, whereby a multi-color image excellent in color balance can be provided when the image-recording composition comprises a plurality of leuco-dyes. The image-recording sheet of the present invention using the image-recording composition is remarkably useful for pressure-sensitive, heat-sensitive image-recording. The present disclosure relates to subject matter contained in Japanese Patent Application No. 2000-145521 (filed on May 17, 2000) which is expressly incorporated herein by reference in its entirety.

What is claimed is:

1. An image-recording composition capable of rapidly developing a color at a temperature of 40 to 95° C. comprising:

a microcapsule enclosing a leuco-dye in an oil;

a phenol color-developing agent having four or more phenol groups and a number-average molecular weight (Mn) of 600 to 50,000; and a reaction-accelerating agent catalyzing a color-developing reaction between said leuco-dye and said phenol color-developing agent, said reaction-accelerating agent being an organic compound having at least two carboxyl groups, wherein the ratio of [the number of said carboxyl groups of said reaction-accelerating agent]/[the number of carbon atom(s) of said reaction-accelerating agent other than carbon atoms forming said carboxyl groups] is 0.2 or more, and the concentration of said reaction-accelerating agent being 0.3 part by weight or less based on 1 part by weight of said phenol color-developing agent.

2. The image-recording composition according to claim 1, wherein said reaction-accelerating agent is a carboxylated aliphatic hydrocarbon having 1 to 20 carbon atoms, a carboxylated aromatic compound having 6 to 20 carbon atoms, or a carboxylated heterocyclic compound having 4 to 20 carbon atoms.

3. The image-recording composition according to claim 1, wherein said reaction-accelerating agent is an oligomer or a polymer.

4. The image-recording composition according to claim 1, wherein said reaction-accelerating agent is selected from the group consisting of oxalic acid, malonic acid, succinic acid, maleic acid, citric acid, 1,2,3,-propanetricarboxylic acid, butanetetracarboxylic acid, sebacic acid, mellitic acid, hemimellitic acid, trimellitic acid, pyromellitic acid, 1,2,3, 4,-cyclopentanetetracarboxylic acid, 1,2,3,4,5,6, cyclopentanetetracarboxylic acid, tetrahydrofuran-2,3,4,5-tetracarboxylic acid, polyacrylic acid, and maleic anhydride-vinyl compound copolymers.

5. The image-recording composition according to claim 1, comprising a sensitizer.

6. The image-recording composition according to claim 5, wherein said sensitizer is represented by the following formula (I):

(I)

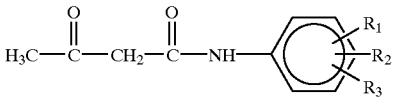

wherein $R_1$, $R_2$ and $R_3$ independently represent a hydrogen atom, a halogen atom, or alkyl or alkoxy group having 1 to 8 carbon atom.

7. The image recording recording composition according to claim 1, wherein said image-recording composition comprises at least two kinds of microcapsules that are broken under a different condition to release a leuco-dye exhibiting a different color.

8. The image-recording composition according to claim 7, wherein said image-recording composition is a pressure-sensitive, heat-sensitive image-recording composition comprising a first microcapsule enclosing a first leuco-dye and a second microcapsule enclosing a second leuco-dyc, said first microcapsule is broken under a first pressure at a first temperature, said second microcapsule is broken under a second pressure lower than said first pressure at a second temperature higher than said first temperature, and said first leuco-dye and said second leuco-dye exhibit a color different from each other.

9. An image-recording sheet comprising a substrate and a color-developing layer disposed by applying the image-recording composition recited in claim 1 to said substrate.

10. An image-recording composition comprising:

a microcapsule enclosing a leuco-dye in an oil;

a phenol color-developing agent; and a reaction-accelerating agent catalyzing a color-developing reaction between said leuco-dye and said phenol color-developing agent, said reaction-accelerating agent being an organic compound having at least two carboxyl groups, said image-recording composition capable of exhibiting a color by allowing said leuco-dye in a core of a microcapsule to mix and react with not only said phenol color-developing agent but also said reaction-accelerating agent by breaking said microcapsule.

* * * * *